US006716095B1

(12) United States Patent
Hsu et al.

(10) Patent No.: US 6,716,095 B1
(45) Date of Patent: Apr. 6, 2004

(54) CORDLESS SURFACE DRESSER

(75) Inventors: Chih-Hua Hsu, Taichung (TW); Kun-Lin Li, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 4 days.

(21) Appl. No.: 10/338,527

(22) Filed: Jan. 8, 2003

(51) Int. Cl.[7] ..... B24B 23/00

(52) U.S. Cl. ..... 451/358; 451/443; 451/344; 451/451; 451/259; 451/359

(58) Field of Search ..... 451/358, 443, 451/342, 363, 356, 357, 557, 524, 451, 344

(56) References Cited

U.S. PATENT DOCUMENTS 5,020,281 A * 6/1991 Neff ..... 451/358
5,201,146 A * 4/1993 Fushiya ..... 451/358
5,826,478 A * 10/1998 Zerrer ..... 83/169
6,306,024 B1 * 10/2001 Kai et al. ..... 451/357
6,394,884 B1 * 5/2002 Wuensch ..... 451/357
6,511,369 B2 * 1/2003 Chi ..... 451/344
6,527,630 B2 * 3/2003 Mannsperger et al. ..... 451/344

* cited by examiner

*Primary Examiner*—Lee D. Wilson
(74) *Attorney, Agent, or Firm*—Alan D. Kamrath; Rider Bennett, LLP

(57) ABSTRACT

A surface dresser for removing contaminants includes a body assembly with a stationary seat and an adjustable assembly with a dressing wheel. The adjustable assembly is rotatably mounted on an outer periphery of the stationary seat. Two pairs of pin holes are defined in the stationary seat, and a flexible pin with two short ends is movably mounted in each pair of pin holes. A latch is slidably attached on the outer periphery of the stationary seat and has two clamping holes and two detents corresponding to two adjacent pin holes. When the adjustable assembly is rotated relative to the body assembly by a specific angle, the flexible pins selectively engage the clamping holes and the detents in the latch to lock the adjustable assembly. Consequently, the angle of the dressing wheel is adjustable to accommodate various requirements.

11 Claims, 8 Drawing Sheets

CORDLESS SURFACE DRESSER

BACKGROUND OF THE INVENTION

1. Field of the Invention

The present invention relates to a surface dresser, and more particularly to a cordless surface dresser with a body and a dressing wheel with a rotating axis that can be rotated relative to the body to accommodate working space limitations.

2. Description of Related Art

Flat surface dressers are used to prepare and smooth a surface of building materials such as wood, stone, concrete, etc. For example, flat surface dressers are used to remove old or peeling wallpaper from walls or old advertisements from billboards or to polish surfaces of metal. A conventional flat surface dresser comprises a body and a dressing wheel. The dressing wheel is rotatably mounted on the body and adapted to smooth and prepare the surface of an object or for polishing. In removing contaminates applications, a rubber dressing wheel is used to smooth and prepare a surface, and a steel wool dressing wheel is used for polishing.

However, direct access to all areas of objects is not always uniform, and the dressing wheel must be perpendicular to the surface of the object for the surface dresser to properly prepare a surface. Because the dressing wheel cannot rotate relative to the body of the conventional flat surface dresser, the operator must rotate or adjust the entire surface dresser to maintain a suitable processing angle between the surface of the object and the dressing wheel. Operating the conventional flat surface dresser can be cumbersome, inconvenient and tiring.

Furthermore, preparing a surface in a small space that limits the positioning of the conventional flat surface dresser may be virtually impossible.

To overcome the shortcomings, the present invention provides a cordless surface dresser with a dressing wheel that can be adjusted relative to the body to mitigate or obviate the aforementioned problems.

SUMMARY OF THE INVENTION

The main objective of the invention is to provide a cordless surface dresser with a dressing wheel that can be adjusted relative to a body assembly to accommodate working space limitations.

Another objective of the invention is to provide a cordless surface dresser convenient to operate.

Other objectives, advantages and novel features of the invention will become more apparent from the following detailed description when taken in conjunction with the accompanying drawings.

DETAILED DESCRIPTION OF PREFERRED EMBODIMENT

Figure 1:
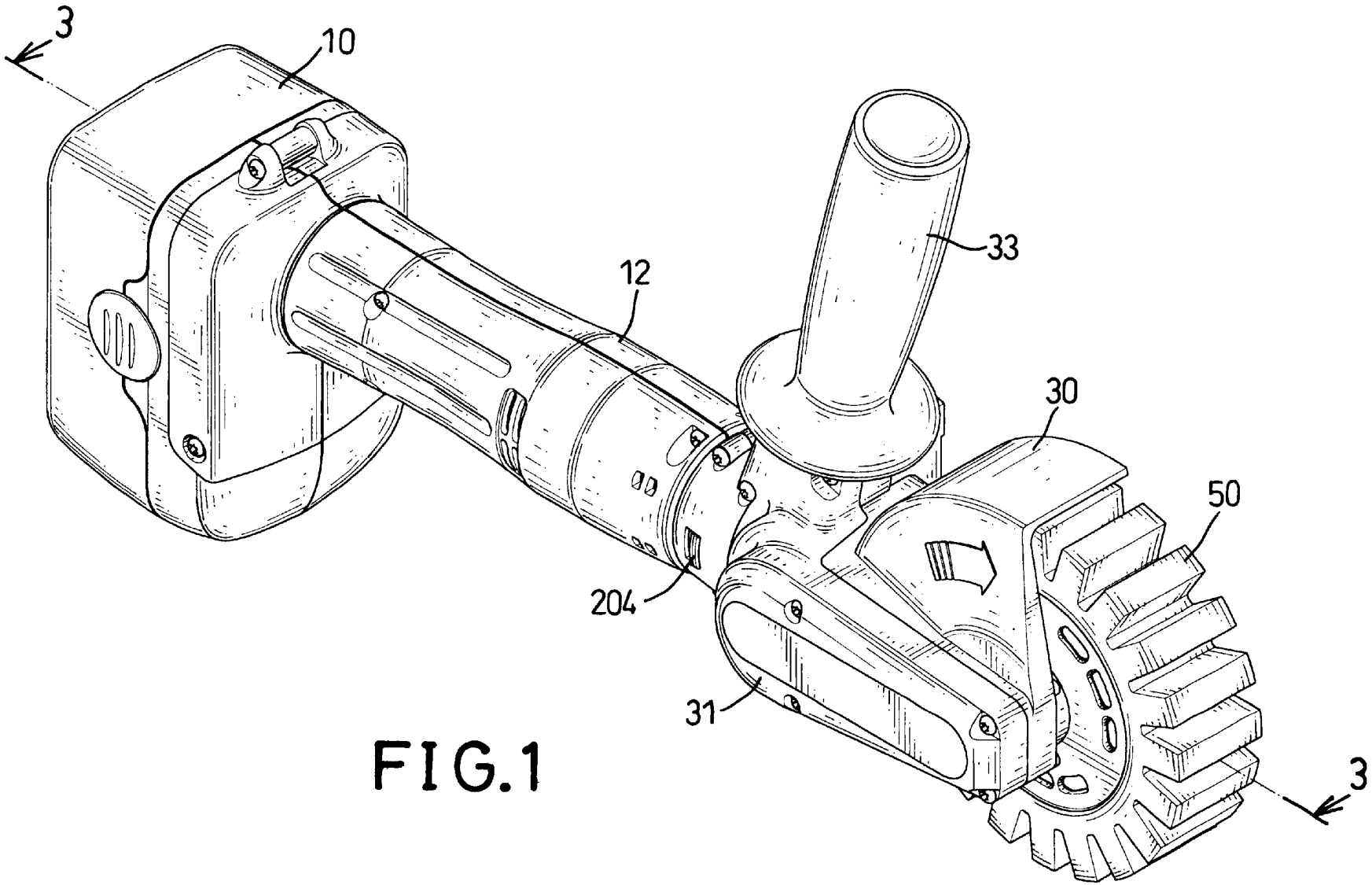
FIG. 1 is a perspective view of a cordless surface dresser in accordance with the present invention.
Figure 2:
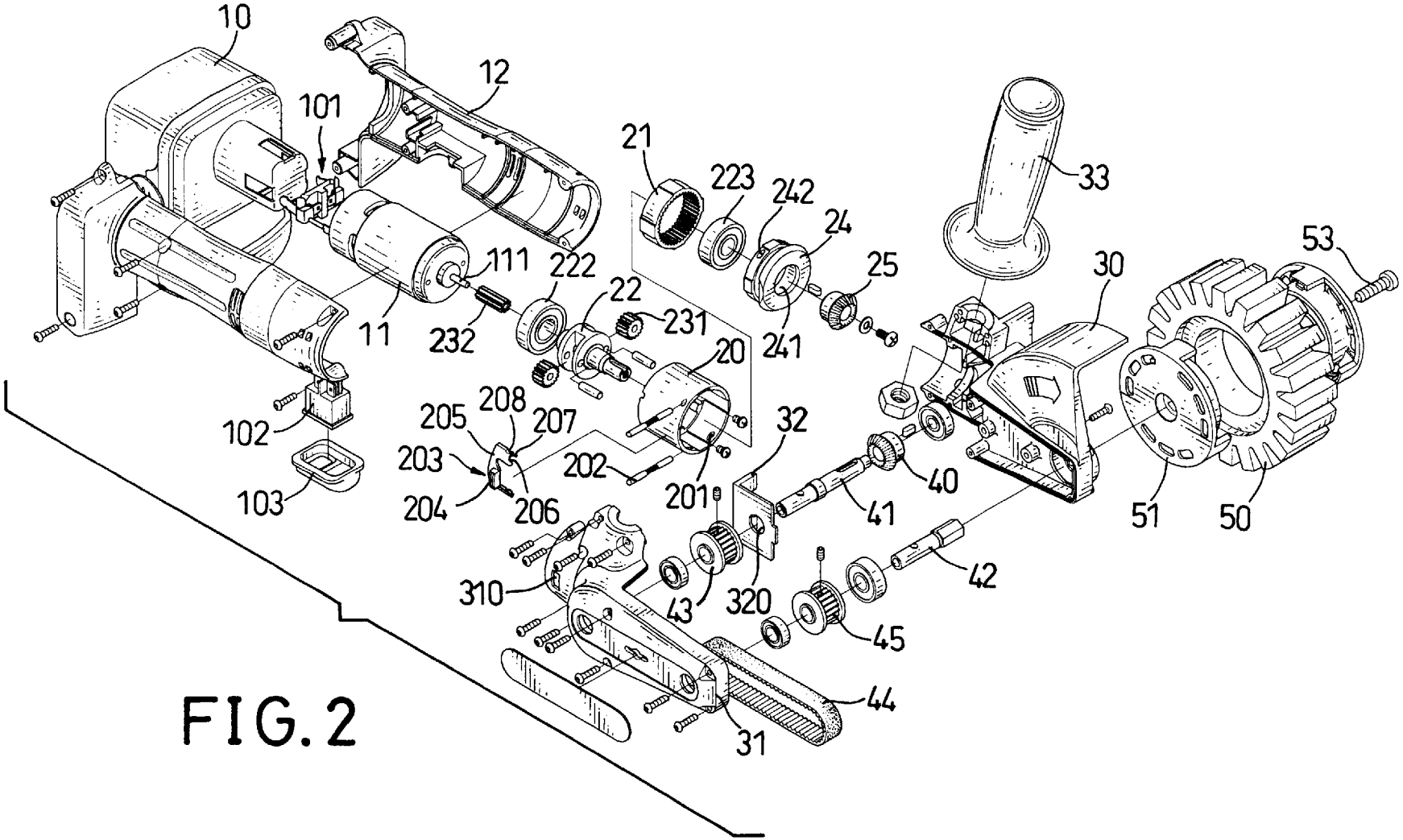
FIG. 2 is an exploded, perspective view of the cordless surface dresser in FIG. 1.
Figure 3:
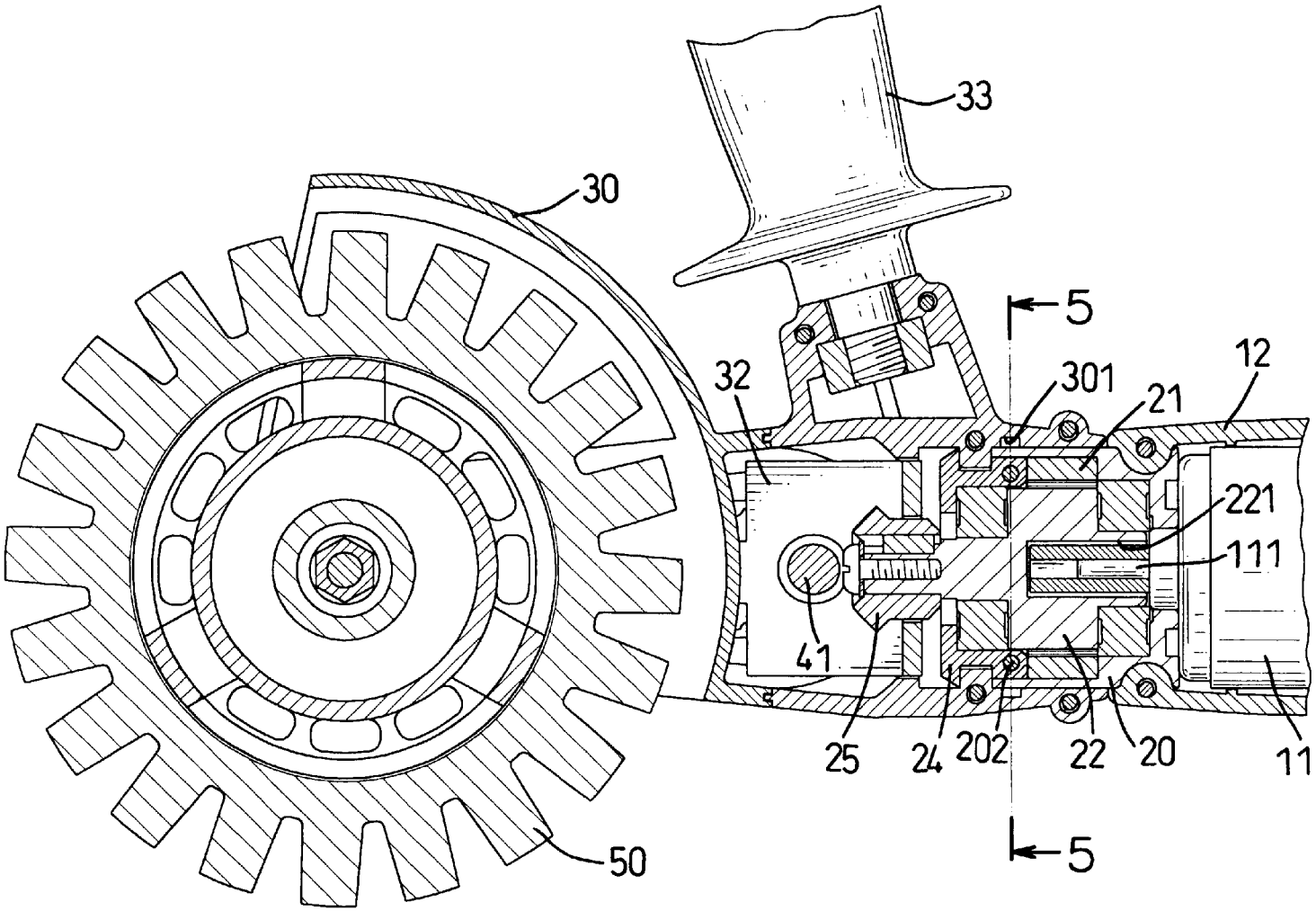
FIG. 3 is an enlarged cross sectional side plan view of the cordless surface dresser along 3—3 line in FIG. 1.

With reference to FIGS. 1 to 3, a cordless surface dresser for polishing and smoothing a surface of an object comprises a body assembly (not numbered) and an adjustable assembly (not numbered).

The body assembly comprises a power assembly (not numbered), a transmission assembly (not numbered) and a housing (12). The power assembly comprises a battery (10), a motor (11) and a connector (101). The connector (101) is electrically connected in series between the battery (10) and the motor (11). A switch (102) is electrically connected to the motor (11) and the battery (10) and attached to the housing (12) to turn the motor (11) on and off. A protective cover (103) is mounted over the switch (102) on the housing (12) to prevent the switch (102) from being touched inadvertently.

The motor (11) has a drive shaft (111) rotatably mounted in the motor (11), which has an outer end (not numbered) that extends out of the motor (11). The outer end of the drive shaft (111) of the motor (11) is used to connect to the transmission assembly. The motor (11) and the transmission assembly are mounted in the housing (12). The housing (12) includes two half bodies (not numbered) and has a rear end (not numbered) and a front opening (not numbered). The rear end is securely attached to the battery (10).

The transmission assembly comprises a stationary seat (20), a spindle (22), a fixed cover (24), a planetary reduction gear (not numbered) and a first bevel gear (25). The stationary seat (20) is hollow, has an inner surface (not numbered) and an outer periphery (not numbered) and is securely mounted and partly held in the front opening of the housing (12). Four keyways (not numbered) are defined symmetrically and longitudinally in the inner surface of the stationary seat (20). A pair of first pin holes (201) that each has two aligned bores (not numbered) defined in the in the stationary seat (20) are defined transversely in the stationary seat (20). The first pin holes (201) are parallel to each other near the front opening of the housing (12).

The spindle (22) has a coupling end (not numbered) and an elongated end (not numbered). A gear hole (221) is defined in the coupling end of the spindle (22). The spindle (22) is rotatably mounted in the stationary seat (20) with the planetary reduction gear by means of a bearing (222) mounted in the housing (12) around the coupling end of the spindle (22), and a bearing (223) mounted in the fixed cover (24) around the elongated end of the spindle (22). The planetary reduction gear comprises a ring gear (21), two planet carriers (231) and a sun gear (232). The ring gear (21) has an outer periphery (not numbered) and an inner surface (not numbered). Four keys (not numbered) corresponding to the keyways on the inner surface of the stationary seat (20) are formed on the outer periphery of the ring gear (21). A series of gear teeth (not numbered) are defined on the inner surface of the ring gear (21). The ring gear (21) is securely mounted in the stationary seat (20) by fitting the keys respectively in the keyways of the stationary seat (20). The planet carriers (231) are diametrically attached to the spindle (22) and engage the teeth on the inner surface of the ring gear (21). The sun gear (232) is securely mounted on the outer end of the motor (11) shaft (111), extends through the gear hole (221) in the coupling end of the spindle (22) and simultaneously engages the two planet carriers (231) to rotate the spindle (22).

The fixed cover (24) has four keys (not numbered), a flange (not numbered) and a central hole (241) defined axially through the fixed cover (24). The keys of the fixed cover (24) respectively fit in the keyways in the stationary seat (20), and the fixed cover (24) abuts the ring gear (21). The elongated end of the spindle (22) passes through and extends out of the central hole (241) in the fixed cover (24). A keyway (not numbered) is defined longitudinally in the elongated end of the spindle (22), and a threaded hole (not numbered) is defined axially in the elongated end. A pair of second pin holes (242) that each has two aligned bores (not numbered) defined in the fixed cover (24) are defined transversely in the fixed cover (24) corresponding to the pair of first pin holes (201) in the stationary seat (20), respectively. A flexible pin (202) is mounted in each pair of the corresponding first pin hole (201) and second pin hole (242). Each flexible pin (202) comprises two short ends (not numbered) and a spring (not numbered) securely connected between the two short ends. The short ends are slidably mounted in the corresponding pin holes (201, 242) and partially extend out of the first pin holes (201) in the stationary seat (20).

The first bevel gear (25) is attached to the elongated end of the spindle (22) by means of a key (not numbered) and a screw (not numbered). The key is mounted in the keyway in the spindle (22) and the screw is screwed into the threaded hole in the elongated end of the spindle (22).

A latch (203) is slidably mounted on the outer periphery of the stationary seat (20). The latch (203), is U-shaped and has a tab (204) and two parallel arms (205). The tab (204) is formed integrally with and protrudes from the latch (203) and is adapted to be pushed by a fingertip of an operator. Each arm (205) has an end (not numbered) and an outside side (not numbered). A clamping recess (206) is defined in each end, and a first detent (207) and a second detent (208) are defined in sequence in the outside side of the arm (205).

The adjustable assembly comprises a shell assembly (not numbered), a transmission mechanism (not numbered) and a dressing wheel mechanism (not numbered). The shell assembly comprises a protective member (not numbered), a standoff (32) and a handle (33). The protective member includes a combination debris guard and housing shell (30) and a housing shell (31). The combination debris guard and housing shell (30) has a right side (not numbered) and a left side (not numbered), and the transmission mechanism is attached at the left side and the dressing wheel mechanism is attached at the right side of the combination debris guard and housing shell (30). The housing shell (31) is attached to the combination debris guard and housing shell (30), and the transmission mechanism is mounted between them. The protective member is rotatably mounted on the outer periphery of the stationary seat (20) and has an inner annular guide (301) with an inner surface (not numbered) corresponding to the short ends of the flexible pins (202).

Figure 4:
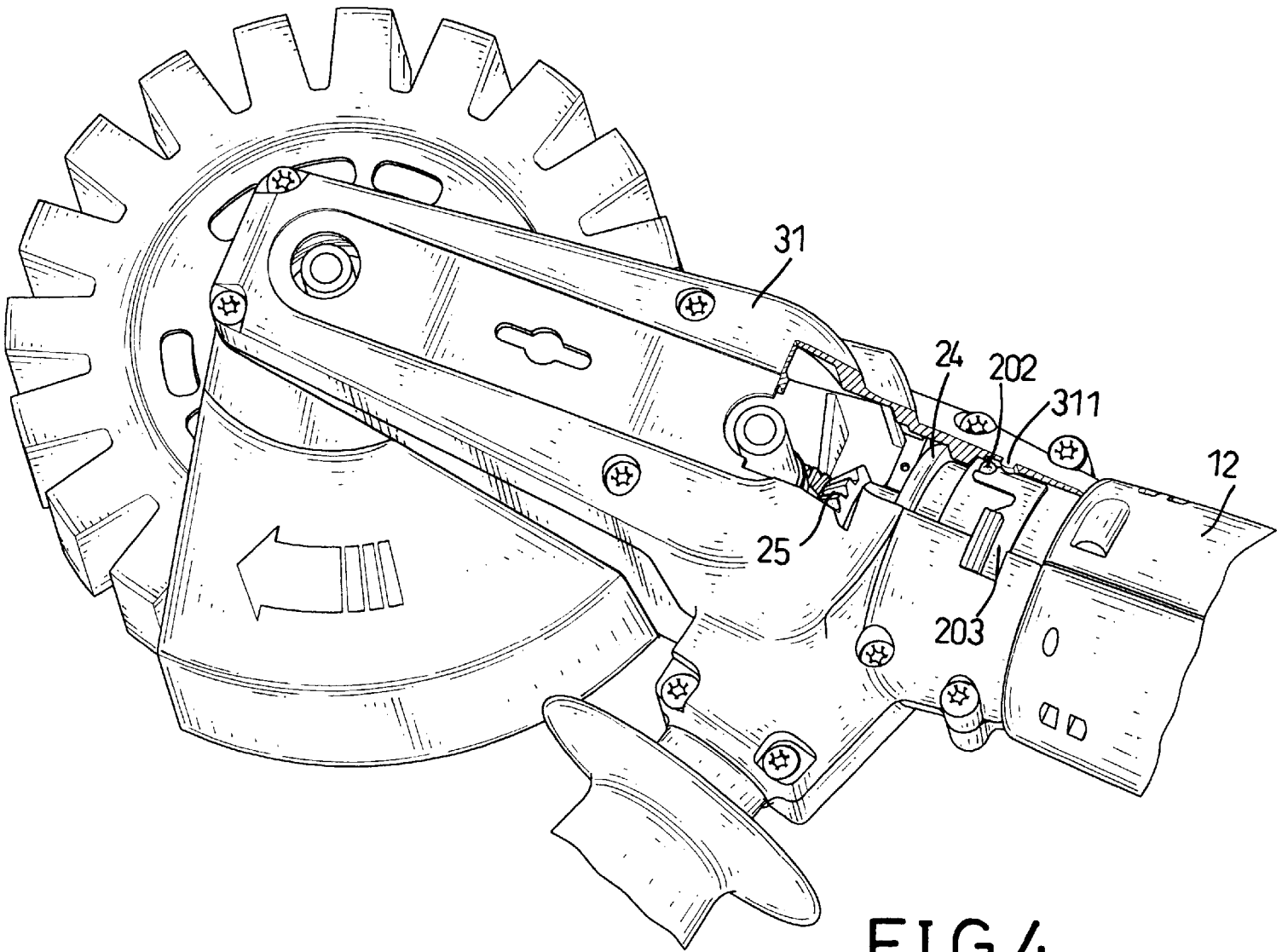
FIG. 4 is a perspective view in partial section of the cordless surface dresser in FIG. 1 showing the short ends of the flexible pins held in the clamping recess in the latch.
Figure 5:
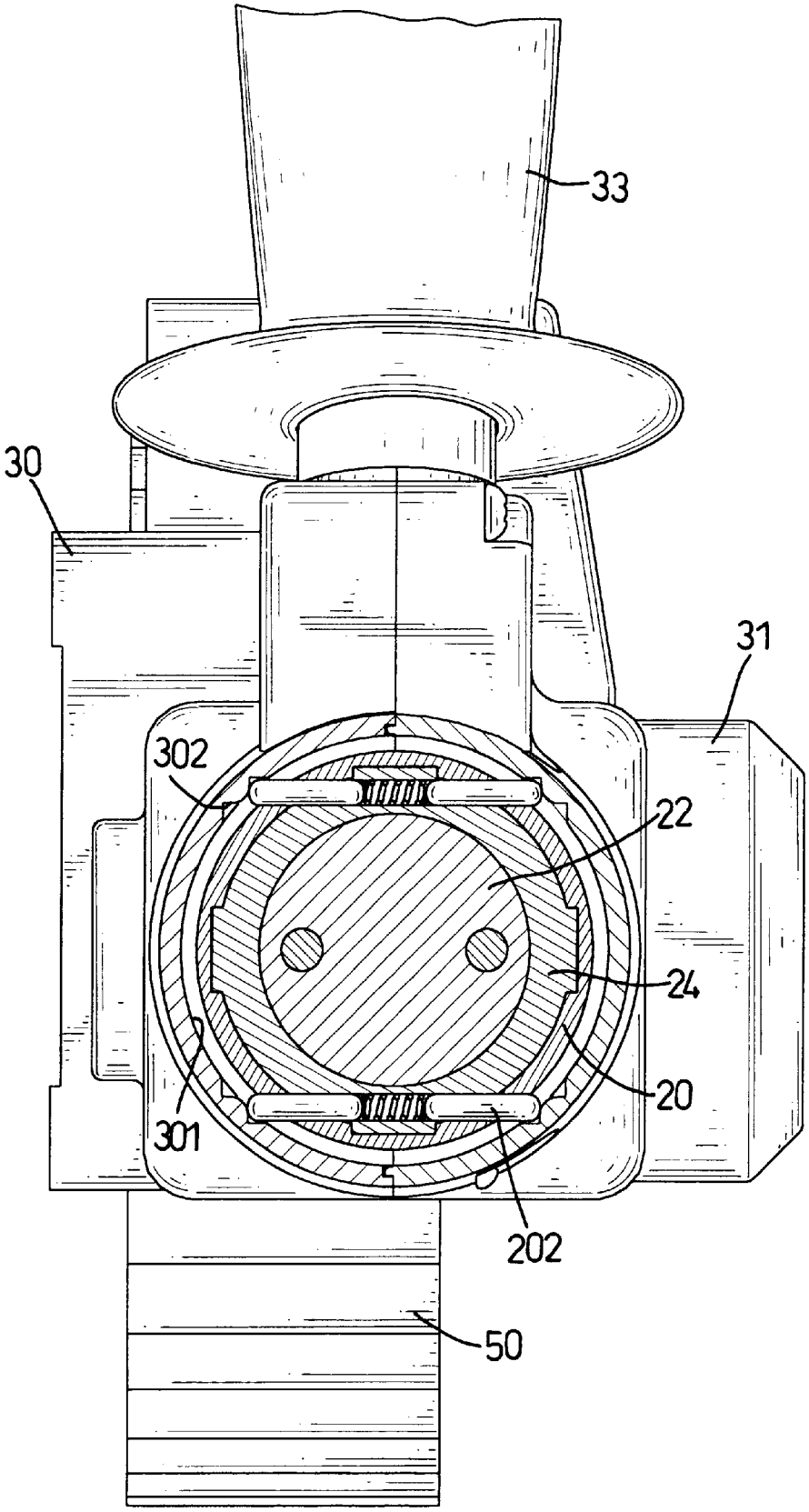
FIG. 5 is a front plan view in partial section of the cordless surface dresser along 5—5 line in FIG. 3.

With reference to FIGS. 2 and 4, two inner stubs (311) are formed in the protective member corresponding to the first and second detents (207, 208). Each stub (311) is selectively held in one of the first and second detents (207, 208). A tab hole (310) is defined in the protective member to receive the tab (204) on the latch (203) so the tab (204) on the latch (203) is easy to be pushed. With reference to FIG. 5, eight pin detent (302) are defined in the inner surface of the annular guide (301) corresponding to the short ends of the flexible pins (202) that are placed vertically or horizontally. Each pin detent (302) in the inner annular guide (301) is used to hold one of the corresponding short ends of the flexible pins (202) in place.

With reference to FIG. 2, the standoff (32) with a through hole (320) is mounted between the combination debris guard and housing shell (30) and the other housing shell (31) near the first bevel gear (25). The auxiliary handle (33) is securely attached to the protective member for the operator to grip.

The transmission mechanism comprises a second bevel gear (40), a transmission shaft (41), a transmission belt device (not numbered) and a driving shaft (42). The second bevel gear (40) is securely coupled to the transmission shaft (40) by a key (not numbered) and engages the first bevel gear (25) to rotate the transmission shaft (41). The transmission shaft (41) has a left end and a right end. The right end of the transmission shaft (41) is coupled to the transmission belt device, and the left end of the transmission shaft (41) passes through the through hole (320) in the standoff (32) and is coupled to the second bevel gear (40). The transmission belt device includes a transmission traction wheel (43), a drive traction wheel (45) and a transmission belt (44). The transmission traction wheel (43) is attached to the left end of the transmission shaft (41), and the drive traction wheel (45) is attached the driving shaft (42). The transmission belt (44) is mounted around the transmission traction wheel (43) and the drive traction wheel (45). The driving shaft (42) has a gear end (not numbered) that is connected to the drive traction wheel (45) and a multi-faceted end (not numbered) with a threaded hole (not numbered) that passes from the left side to right side through the combination debris guard and housing shell (30). The dressing wheel mechanism includes a dressing wheel (50) with a central axis, a rim (51) and a fastener (53). The dressing wheel (50) is made of rubber to remove contaminants from the surface of an object or is made of steel wool to polish the surface of metal. The dressing wheel (50) is attached to the multi-faceted end of the driving shaft (42) by means of the rim (51) clamping it and the fastener (53), such as a bolt, screwing into the threaded hole in the multi-faceted end of the driving shaft (42).

Figure 6:
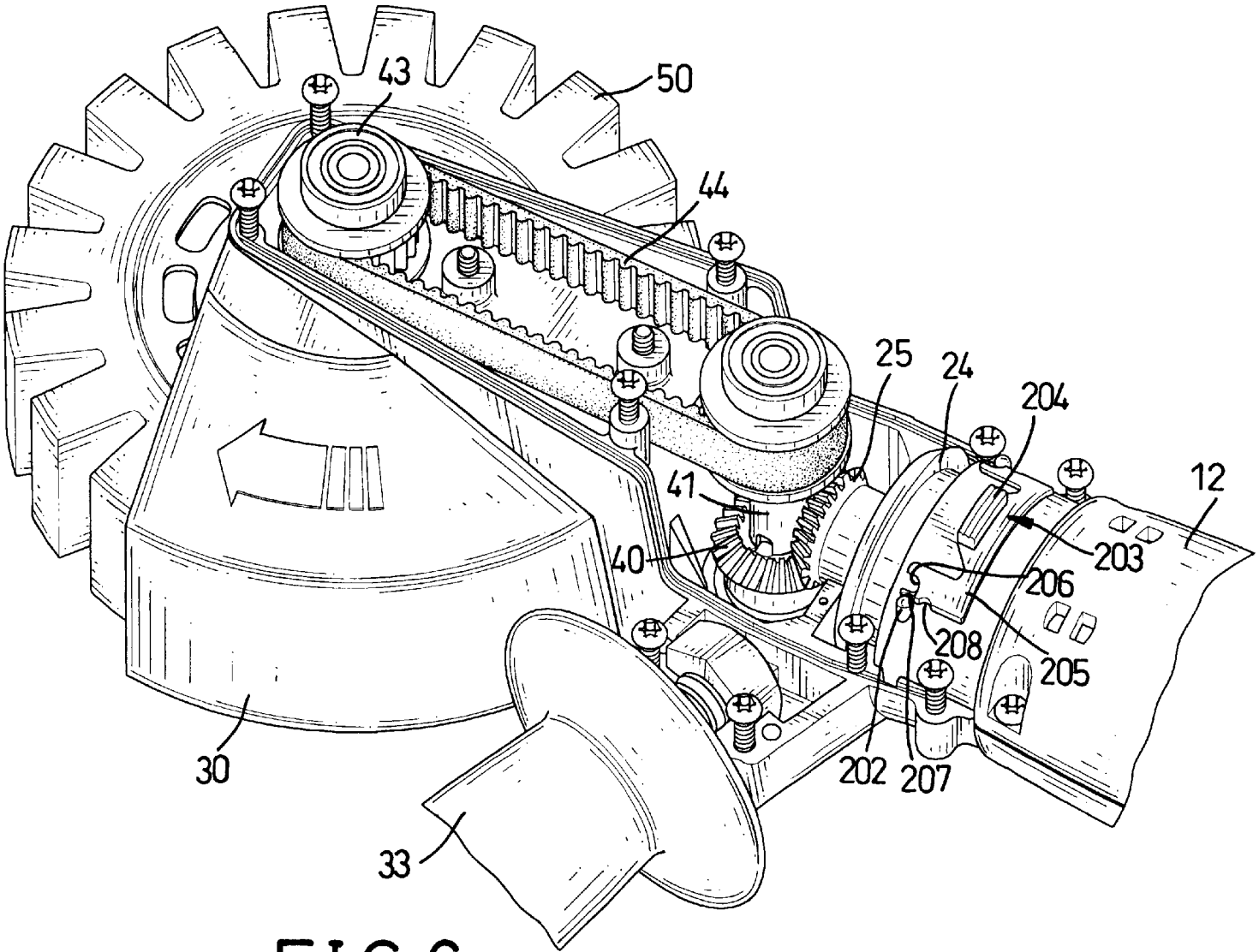
FIG. 6 is an enlarged perspective view in partial section of the cordless surface dresser in FIG. 1 showing the first detents in the latch holding the short ends of the flexible pins.

With reference to FIGS. 5 and 6, the flexible pins (202) are positioned parallel to the central axis of the dressing wheel (50), and the short ends of the flexible pins (202) are respectively held in corresponding pin detents (302). Meanwhile, the latch (203) is pushed toward the dressing wheel (50), and two of the short ends of a flexible pin (202) corresponding to the first detents (207) in the latch (203) are held in the first detents (207) respectively. With reference to FIG. 4, the second detents (208) engage the inner stubs (311) in the protective member. At this time, the adjustable assembly cannot rotate relative to the body assembly because the latch (203) limits revolutions of the flexible pins (202).

Figure 7:
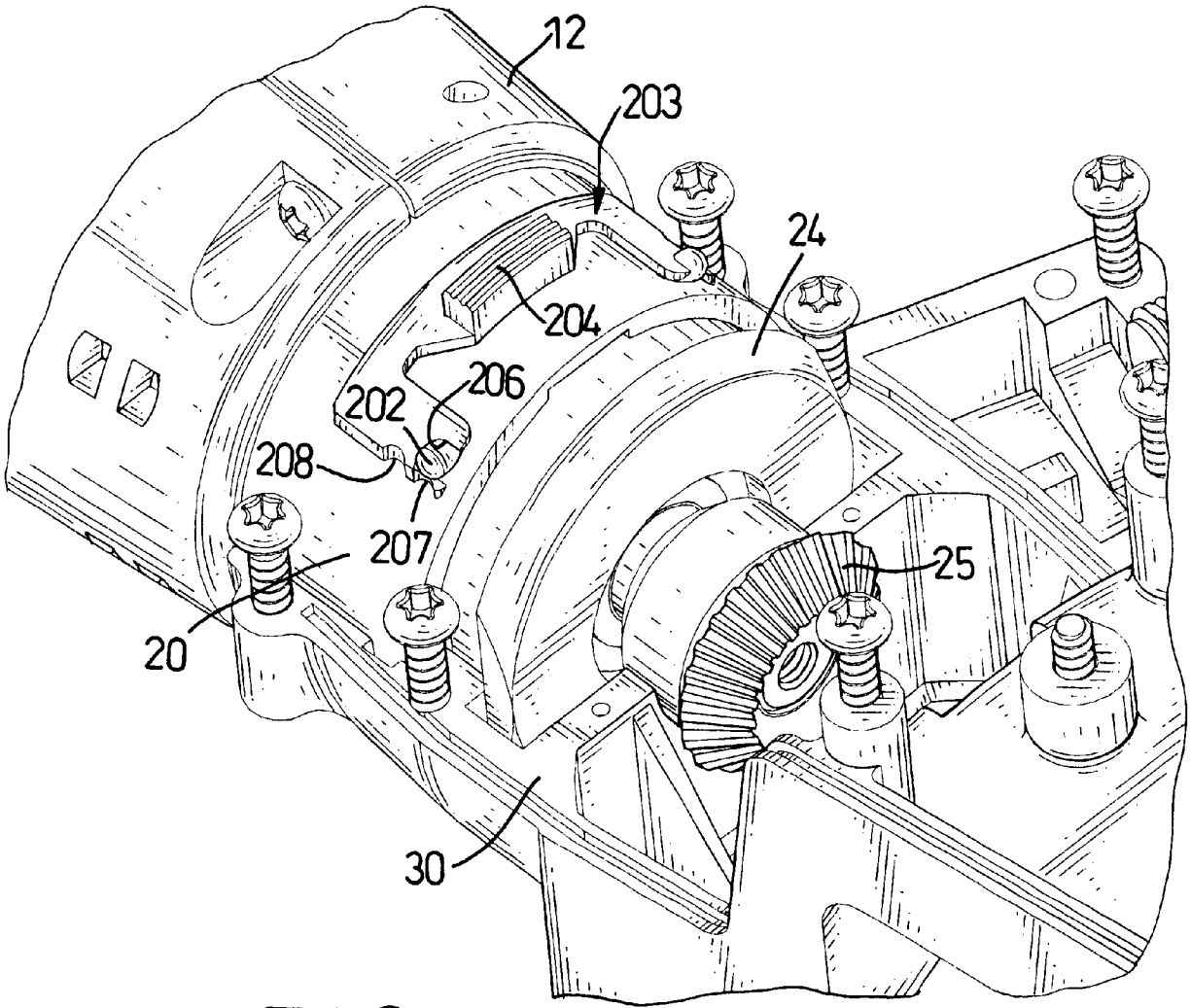
FIG. 7 is an enlarged perspective view in partial section of the cordless surface dresser transmission assembly in FIG. 1 showing the clamping holes in the latch holding the short ends of the flexible pins.

When the relationship between the dressing wheel (50) and the body assembly needs to be changed, the tab (204) on the latch (203) is pushed toward the housing (12). The first detents (207) disengage the short ends of the flexible pin (202) and engage the inner stubs (311) in the protective member to keep the latch (203) in position. The operator can rotate the adjustable assembly 90 degrees relative to the body assembly. The short ends of the flexible pins (202) slide in the inner annular guide (301) in the protective member and compress the springs in the flexible pins (202). After the 90 degrees rotation, the flexible pins (202) are perpendicular relative to the central axis of the dressing wheel (50), and the short ends of the flexible pins (202) are pushed by the spring to be respectively held in the corresponding pin detents (302) in the inner annular guide (301). With reference to FIGS. 4 and 7, the latch (203) is pushed toward the dressing wheel (50), and the clamping recesses (206) in the latch (203) will respectively engage two short ends of one of the corresponding flexible pins (202). The second detents (208) respectively position the inner stubs (311) in the protective member to prevent the latch (203) from moving.

With reference to FIGS. 3 and 6, the motor (11) rotates the drive shaft (111) that rotates the spindle (22). The spindle (22) rotates the first bevel gear (25) that rotates the second bevel gear (40). The second bevel gear (40) rotates the transmission shaft (41) that rotates the driving shaft (41) by means of the transmission belt device. Finally, the driving shaft (41) rotates the dressing wheel (50) to dress the surface of an object. Because rotating power is transmitted by the bevel gears (24, 40), the rotating power is not affected by the adjustable assemble rotating relative to the body assembly.

Figure 8:
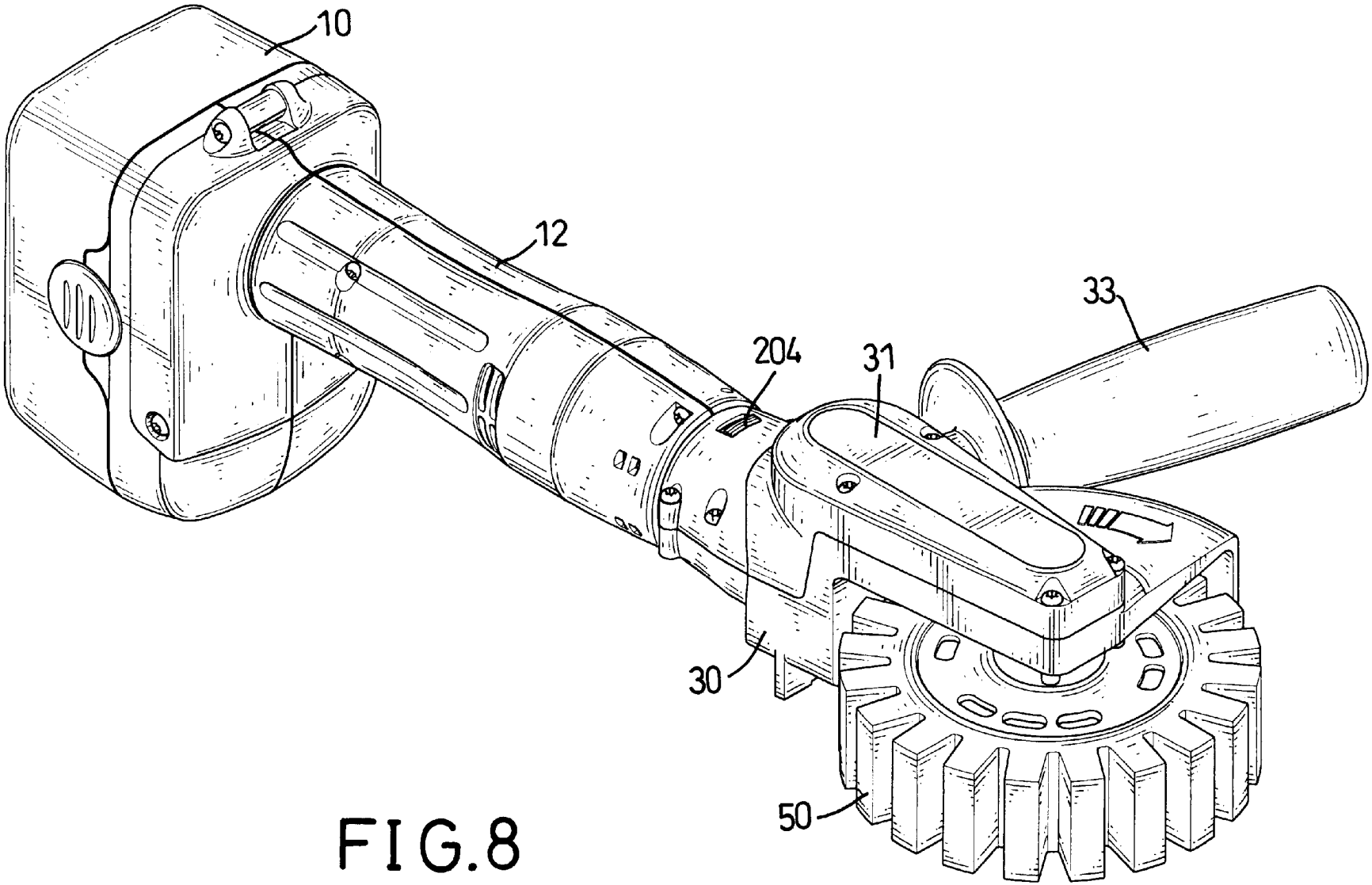
FIG. 8 is a perspective view of the cordless surface dresser in FIG. 1 showing the dressing wheel rotated relative to the body assembly.

With reference to FIGS. 1 and 8, the dressing wheel (50) of the cordless surface dresser can be adjusted to accommodate the shape of an object and the working space limitations. The positions and numbers of the pin detents (302) in the inner annular guide (301) can be changed to allow the dressing wheel (50) to be rotated to specific angles, such as 30 degrees, 45 degrees or 60 degrees, to suit requirements of the operator. The cordless surface dresser in accordance with the present invention is more convenient than the conventional surface dresser.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cordless surface dresser for processing a surface of an object and the cordless surface dresser comprising:

a body assembly comprising a housing, a power assembly and a transmission assembly, and the housing with a rear end and a front opening comprising two half bodies encased the motor and the transmission assembly;

the power assembly mounted in the housing and the power assembly comprising a battery securely attached to the rear end of the housing;

a motor mounted in the housing and having a drive shaft with an outer end rotatably mounted in the motor, and the outer end of the drive shaft extending out of the motor; and a switch mounted on the housing and electrically connected in series between the motor and the battery, and the switch used to control the motor rotating; and the transmission assembly mounted in the housing and the transmission assembly comprising a stationary seat having an inner surface and an outer periphery and partially secured in the front opening of the housing;

a planetary reduction gear mounted in the stationary seat;

a spindle with a coupling end and an elongated end rotatably mounted in the stationary seat with the planetary reduction gear and rotated by the drive shaft of the motor;

a fixed cover with a central hole through which the elongated end of the spindle passes attached to the stationary seat; and a first bevel gear attached to the elongated end of the spindle; and an adjustable assembly rotatably mounted on the outer periphery of the stationary seat of the body assembly and the adjustable assembly comprising a shell assembly rotatably mounted on the outer periphery of the stationary seat of the body assembly and the shell assembly comprising a protective member rotatably mounted on the outer periphery of the stationary seat and comprising a combination debris guard and housing shell and a housing shell combined with the combination debris guard and housing shell, and the combination debris guard and housing shell having a right side and a left side; and a handle attached to the protective member;

a transmission mechanism mounted at the left side of the combination debris guard and housing shell and encased by the housing shell of the protective member, and the transmission mechanism comprising a second bevel gear engaged the first bevel gear in the transmission assembly;

a transmission shaft with a left end and a right end rotatably mounted in the protective member, and the right end of the transmission shaft coupled to the second bevel gear;

a driving shaft with a gear end and a multi-faceted end, and the multi-faceted end of the driving shaft extending out of the protective member; and a transmission belt device coupled to the left end of the transmission shaft and the gear end of the driving shaft and used to rotate the driving shaft; and a dressing wheel mechanism attached to the right side of the combination debris guard and housing shell and comprising a dressing wheel with a central axis adapted to dress the surface of an object; and a rim clamping the dressing wheel and connected to the multi-faceted end of the driving shaft by means of a fastener;

wherein a pair of first pin holes defined parallel to each other in the stationary seat near the front opening of the housing, and each first pin hole having two aligned bores defined in the stationary seat;

a pair of second pin holes defined parallel in the fixed cover, and each second pin hole having two aligned bores corresponding to the aligned bores of each first pin hole in the stationary seat;

a flexible pin with two short ends movably mounted in the aligned bores of each pair of corresponding first pin hole and second pin hole, and each short end respectively extending out of one of the corresponding aligned bores of the first pin holes;

a latch slidably mounted on the outer periphery of the stationary seat and the latch having a tab protruding from the latch and adapted to be pushed by an operator; and two parallel arms and each arm having an end with a clamping recess defined in the end; and an outside side with a first detent and a second detent defined in sequence in the outside side;

an inner annular guide with an inner space defined in the protective member corresponding to the short ends of the flexible pins;

multiple pin detents defined in the inner surface of the inner annular guide and adapted for respectively receiving the short ends of the flexible pins at a specific angle;

a tab hole defined in the protective member corresponding to the tab on the latch to slidably receive the tab on the latch; and an inner stub formed in the protective member and used to selectively and respectively engage each corresponding one of the first and the second pin holes;

whereby the dressing wheel rotates relative to the body assembly when two of the short ends of the flexible pins selectively disengage from the clamping holes and the first detents in the arm of the latch.

2. The cordless surface dresser as claimed in claim 1, wherein the latch is U-shaped.

3. The cordless surface dresser as claimed in claim 2, wherein eight pin detents are defined in the inner surface of the inner annular guide corresponding to the short ends of the flexible pins that are positioned in a parallel and a perpendicular position relative to the central axis of the dressing wheel.

4. The cordless surface dresser as claimed in claim 3, wherein a spring is mounted between the two short ends of the flexible pins.

5. The cordless surface dresser as claimed in claim 3, wherein the transmission be device comprising a transmission traction wheel attached to the left end of the transmission shaft;

a drive traction wheel attached to the gear end of the driving shaft; and a transmission belt mounted around the transmission traction wheel and the drive traction wheel.

6. The cordless surface dresser as claimed in claim 4, wherein a gear hole is defined in the coup ling end of the spindle, and the planetary reduction gear comprises a ring gear seat with an inner surface and an outer surface where the outer surface is secured in the stationary seat, and a series of teeth are formed on the inner surface;

two planet carriers diametrically mounted on the spindle and engage the teeth on the inner surface of the ring gear; and a sun gear attached to the outer end of the shaft in the motor and passing through the gear hole to simultaneously engage the two planet carriers.

7. The cordless surface dresser as claimed in claim 6, wherein a standoff with a through hole is mounted between the combination debris guard and housing shell and the housing shell near the first bevel gear, and the transmission shaft is rotatably held in the through hole of the standoff.

8. The cordless surface dresser as claimed in claim 7, wherein a protective cover is mounted on the housing over the switch to prevent the switch from being touched inadvertently.

9. The cordless surface dresser as claimed in claim 7, wherein the transmission belt device comprising a transmission traction wheel attached to the left end of the transmission shaft;

a drive traction wheel attached to the gear end of the driving shaft; and a transmission belt mounted around the transmission traction wheel and the drive traction wheel.

10. The cordless surface dresser as claimed in claim 7, wherein a connector is electrically connected in series between the motor and the battery.

11. The cordless surface dresser as claimed in claim 2, wherein a spring is mounted between the two short ends of the flexible pins.

* * * * *